United States Patent [19]

Sisk et al.

[11] Patent Number: 4,714,304

[45] Date of Patent: Dec. 22, 1987

[54] BUILT-IN REFRIGERATOR CABINET

[75] Inventors: George W. Sisk, Center Township, Vanderburgh County; Shelby A. Lynn, Johnson Township, Gibson County; John P. Keil, Ohio Township, Warrick County; John T. Woods, Scott Township, Vanderburgh County, all of Ind.

[73] Assignee: Whirlpool Corporation, Benton Harbor, Mich.

[21] Appl. No.: 946,900

[22] Filed: Dec. 29, 1986

[51] Int. Cl.[4] ..... F25D 11/02

[52] U.S. Cl. ..... 312/214; 62/441; 29/155 R; 312/257 SM

[58] Field of Search ..... 62/440, 441, 447, 465; 29/155 R, 455 R; 228/175, 184; 312/100, 101, 214, 257 SM; 220/467, 469

[56] References Cited

U.S. PATENT DOCUMENTS

| | | | |
|---|---|---|---|
| Re. 19,964 | 5/1936 | Scherer | 62/447 X |
| 1,164,123 | 12/1915 | Schaffert | 312/257 SM X |
| 1,789,916 | 1/1931 | Thornton, Jr. | 62/440 |
| 1,868,353 | 7/1932 | Foster | 62/440 |
| 1,897,205 | 2/1933 | Maccabee | 62/440 |
| 2,257,374 | 9/1941 | Fritz | 62/116 |
| 2,290,190 | 7/1942 | Jacobs | 62/89 |
| 2,442,978 | 6/1948 | Jones | 62/447 X |
| 2,450,844 | 10/1948 | Stuart | 62/116 |
| 2,738,656 | 3/1956 | Philipp | 62/447 X |
| 2,807,154 | 9/1957 | Brosenius et al. | 62/117 |
| 2,810,271 | 10/1957 | Saunders et al. | 62/117 |
| 2,986,900 | 6/1961 | Crotser | 62/263 |
| 3,429,140 | 2/1969 | White | 62/339 |
| 3,526,954 | 9/1970 | Katz et al. | 228/175 |
| 3,712,078 | 1/1973 | Maynard et al. | 62/448 |
| 3,984,223 | 10/1976 | Whistler, Jr. | 62/441 X |
| 4,288,132 | 9/1981 | Znamirowski et al. | 312/257 SM X |
| 4,319,793 | 3/1982 | Suttles | 312/257 SM X |
| 4,540,222 | 9/1985 | Burrell | 312/257 SM X |

*Primary Examiner*—William E. Tapolcai

*Attorney, Agent, or Firm*—Wood, Dalton, Phillips, Mason & Rowe

[57] ABSTRACT

Conventional refrigerator/freezer cabinets are provided with an outer shell having fixed dimensions determined according to total width of inner liners, and thus storage capacity, of the cabinet. For a manufacturer assembling cabinets of varying capacity, it is therefore necessary to stock many different size outer shells. However, to minimize costs it is desirable to use standard parts with any size cabinets. Accordingly, a cabinet construction is disclosed adaptable to provide a plurality of different cabinet widths with one size outer shell section. Each cabinet includes a pair of outer shell sections with each section including a back wall having an inner forwardly turned flange and an inwardly extending end portion. The end portions of the two sections overlap a selected amount determined according to the width of the liners. The end portions are then spot welded to one another.

18 Claims, 3 Drawing Figures

FIG. 1
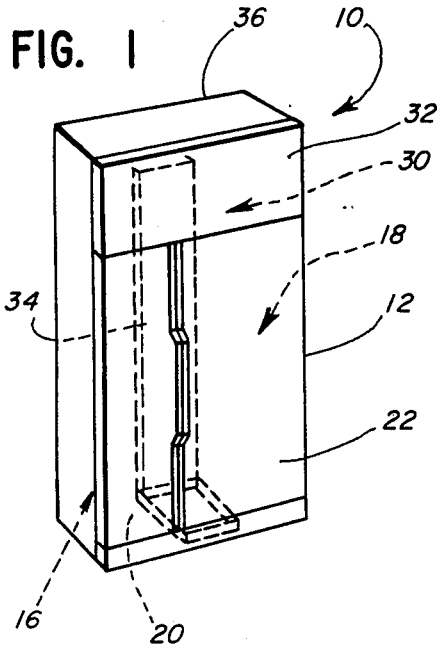
FIG. 2
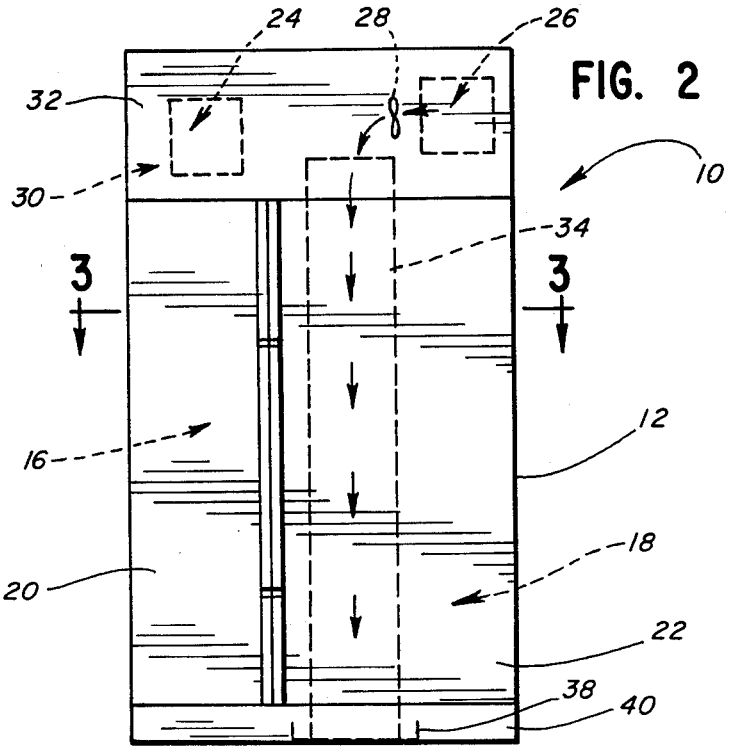
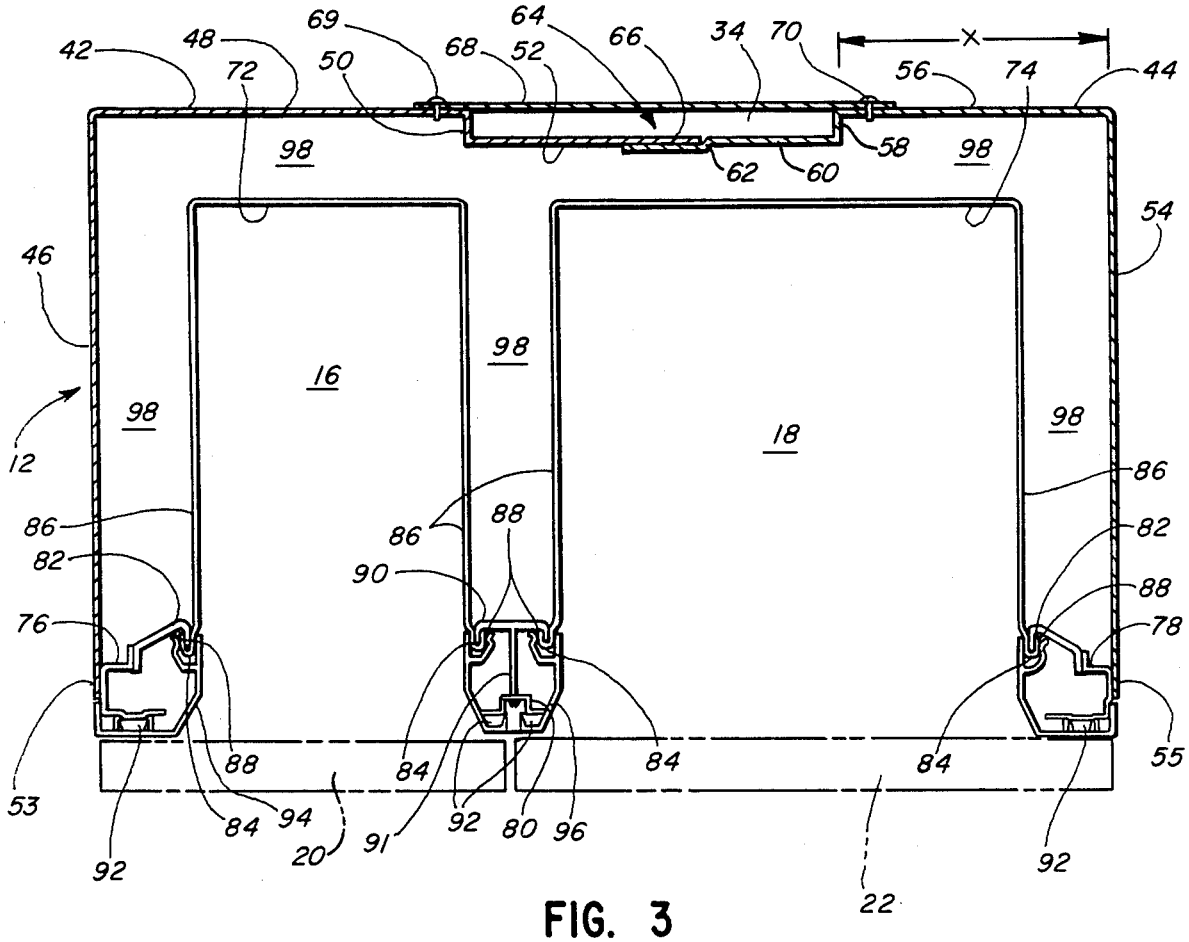
FIG. 3

BUILT-IN REFRIGERATOR CABINET

BACKGROUND OF THE INVENTION

1. Field of the Invention

This invention relates generally to refrigerator cabinets, and more particularly, to an improved cabinet having an outer shell adapted to provide added strength to the cabinet regardless of the cabinet's width.

2. Description of the Background Art

Conventional refrigerator cabinets include an outer shell and an inner liner disposed within and spaced inwardly from the outer shell. A body of insulation is disposed between the shell and the liner. One such arrangement is shown in Morphy U.S. Pat. No. 4,099,812 wherein a rigid structural frame is utilized to provide structural integrity to the cabinet. The outer shell is of steel construction. The frame is provided inwardly of the front perimeter of the outer shell. No such frame is provided along the back of the refrigerator cabinet. However, the coaction between the shell, the liner and the foam add to the rigidity of the entire cabinet.

Alternatively, the outer shell may include a back panel of thicker steel than the remainder of the shell to provide a more rigid construction. Such a rigid construction is beneficial to minimize twisting and swaying of the cabinet when it is being moved.

In certain refrigerator cabinets, it is desirable to use an outer shell of wrap-around sheet metal construction, as shown in Stuart U.S. Pat. No. 2,450,844. With such a wraparound shell, the back panel portion is necessarily of the same thickness as the remainder of the shell. Therefore, the cabinet is more prone to undesirable twisting.

In a refrigerator cabinets having the refrigeration components mounted at the top thereof, such as in Crotser U.S. Pat. No. 2,986,900, the weight of these refrigeration components requires the vertical strength, and thus rigidity, of the cabinet to be increased. As the cabinet is widened, this strength is of even greater importance. The problem is further compounded by the necessity of having an air flow duct down the back of the cabinet. Therefore, it is necessary to provide a cabinet structure providing sufficient rigidity for virtually any cabinet width.

The present invention overcomes the above problems of refrigeration cabinets in a novel and simple manner.

SUMMARY OF THE INVENTION

In accordance with the present invention, a refrigeration apparatus is provided with a cabinet including an outer shell having a duct which acts as a beam adapted to provide added strength thereto for a plurality of different cabinet widths.

Broadly, there is disclosed herein a novel refrigeration apparatus cabinet including a liner having a selected width. An outer shell includes first and second outer shell sections each having a sidewall and a backwall. Means are associated with the backwalls of said outer shell sections for providing a box beam to add strength to said cabinet for any one of a plurality of different selected liner widths.

In the preferred embodiments the backwalls of the outer shell sections include an inner forwardly turned flange and an inwardly extending distal portion. The outer shell sections are of sheet metal construction. The outer shell sections are in opposing relation with the distal portions of each overlapping one another defining a rearwardly opening recess. The two shell sections are spot welded together at their distal ends. A sheet metal cover section overlies the rearwardly opening recess to define a passageway which further acts as a box beam. The box beam increases the strength and rigidity of the cabinet. The cover is secured to the two backwalls by any suitable means. The liner fits within the first and second outer shell sections and is spaced inwardly therefrom. A layer of insulation is disposed between the outer shell sections and the liner. A frame structure is provided around a front periphery of the cabinet to add further rigidity thereto. The frame is spot welded to front marginal edges of the sidewalls of the outer shell sections. A breaker strip extends between the outer shell sections and the liner to provide a heat-break therebetween.

In the preferred embodiment, the layer of insulation is a rigid foam which when it is disposed between the outer shell sections and the liner adjacent the box beam coacts therewith to add extra rigidity to the cabinet.

An additional feature of the present invention is that in a refrigeration apparatus having a top mounted machine compartment the passageway may be used for air passage or as a wire or tubing conduit.

Another feature of the present invention is that the width of the passageway, or box beam, is standard for any width cabinet. Such a result is desirable in that the strength of the cabinet is maintained regardless of the width of the cabinet.

Further features and advantages of the invention will readily be apparent from the specification and from the drawings.

BRIEF DESCRIPTION OF THE DRAWINGS

FIG. 1 is a perspective view of a refrigerator/freezer having a variable width cabinet embodying the invention;

FIG. 2 is a front elevation of the refrigerator of FIG. 1; and

FIG. 3 is a sectional view taken along lines 3—3 of FIG. 2.

DETAILED DESCRIPTION OF THE PREFERRED EMBODIMENT

Referring to FIGS. 1 and 2, a refrigeration apparatus, such as a refrigerator/freezer, 10 includes a cabinet according to the present invention adapted to provide added strength thereto for any one of a plurality of different cabinet widths. The invention is shown utilized with a built-in side-by-side refrigerator/freezer; however, other types of refrigeration apparatus may be used in conjunction with the cabinet construction of the present invention, as will be obvious to those skilled in the art.

The refrigerator/freezer 10 includes a cabinet 12 provided with an insulating separator or divider wall 14, see FIG. 3, defining a below-freezing, or freezer, compartment 16 and a fresh food, or a above-freezing, compartment 18. A freezer door 20 and a fresh food door 22 are provided for selective access to the freezer and fresh food compartments 16, 18, respectively.

The freezer and fresh food compartments 16, 18 are cooled by circulating air therethrough which has been refrigerated as a result of being passed in heat exchange relation with a conventional evaporator (not shown). In addition to the evaporator, the refrigerator/freezer include connected components such as a compressor 24, a condenser 26, and a condenser fan 28 as will be obvious to those skilled in the art. The compressor 24, the condenser 26 and the condenser fan 28 are all provided on a slide out pan (not shown) disposed within an upper machine compartment 30 of the refrigerator/freezer 10. A louvered panel 32 overlying the machine compartment 30 provides an inlet for ambient air which will be drawn across the condenser 26 by the condenser fan 28. Heated air drawn off the condenser 26 by the condenser fan 28 is partially discharged down an inwardly extending air passageway, or a duct, 34 which extends down a back wall 36 of the cabinet 12. The heated air subsequently passes over a defrost water pan 38 located in a bottom portion 40 of the cabinet 12 to aid in the evaporation of defrost water. Water from the evaporator is transferred to the defrost water pan as will be obvious to those skilled in the art.

The construction of the refrigerator/freezer according to the present invention is illustrated in greater detail in the sectional view of FIG. 3.

The cabinet 12 includes first and second outer shell sections 42, 44, respectively. In the preferred embodiment, each outer shell section is manufactured of sheet metal. The first outer shell section 42 has a sidewall 46 and a backwall 48. The back wall 48 includes an inner forwardly turned flange 50 and an inwardly extending distal portion 52. The sidewall 42 includes a front marginal edge 53. Similarly, the second outer shell section 44 includes a sidewall 54 having a front marginal edge 55, and a backwall 56, the backwall including an inner forwardly turned flange 58 and an inwardly extending distal portion 60. The distal portion of the second outer shell section is offset slightly at 62. The offset is determined according to the thickness of the sheet metal. The first and second outer shell sections may be of identical size. Alternatively, one of the outer shell sections 42, 44 may be larger than the other according to the width of the cabinet 12. The outer shell sections 42, 44 are in opposing relation with the sidewalls 46, 54 thereof in substantially parallel alignment. The distal portions 52, 60 of the outer shell sections 42, 44, respectively, are in overlapping relation with the offset 62 providing a substantially flush outer surface. The outer shell sections 46, 54 thereby define a rearwardly opening recess 64. The cabinet width may be varied by changing the width X of the backwall 56 of the second outer shell section 44. The distal portions 52, 60 are secured together with a plurality of spot welds 66.

A sheet metal cover section 68 overlies the rearwardly opening recess 64 defining the duct 34. The cover 68 is secured to the first outer shell section 46 at 69 by, for example, screws. The cover 68 is similarly secured to the second outer shell section 54 at 70. A plurality of such spot welds are provided along the full longitudinal extent of the cover 68.

In addition to providing an air passageway, the duct 34 also acts as a conduit for wiring and tubing as is required between the connected components previously discussed, and additional controls (not shown) as will be obvious to those skilled in the art. More importantly, the duct 34 acts as a box beam which adds structural rigidity to the cabinet to inhibit twisting and swaying of the cabinet.

An inner freezer section liner 72 is disposed within and spaced inwardly from the outer shell sections 42, 44. Similarly, a fresh food compartment liner 74 is disposed within and spaced inwardly from the outer shell sections 42, 44 and the freezer section liner 72. Each liner 72, 74 has a selected width according to the storage capacity of each of the compartments 16, 18, respectively. The selected width of the liners determine the volumetric capacity of the refrigerator/freezer, and thus the overall cabinet dimensions.

According to the present invention, as the width of the cabinet 12 is varied for different refrigerator/freezer models, a second outer shell section 44 is selected having dimension X necessary to accommodate the cabinet width. The dimensions of the first outer shell section are unchanged for any cabinet width. For example, a 36" wide cabinet has an X dimension 6" greater than a 30" cabinet. Thus fewer component parts need be utilized across model lines. Moreover, the size of the duct, and thus box beam is maintained regardless of width to insure structural integrity for any width cabinet. Similarly, the position of the duct relative to the first outer shell section sidewall 46 remains fixed for any cabinet width.

The cabinet 12 includes a steel support frame of channel construction including a first side section 76 which is spot welded to the front marginal edge 53 of the sidewall 46 and a second side section 78 which is spot welded to the front marginal edge 55 of the sidewall 54. A divider wall frame section 80 is secured at its top and bottom to upper and lower support frames (not shown). The entire support frame provides a support structure for the cabinet 12. A plurality of plastic spacer members 82 are secured to the side sections 76, 78 of the support frame using any known means, such as screws, rivets or self locking means.

Each liner 72, 74 includes a front edge portion 84 which comprises a turned end portion extending substantially at a right angle to a sidewall 86 thereof and terminating in a return distal portion 88. An edge of the spacer members 82 are force fit within the front edge portions 84. Additional spacer members 90 are included for the divider wall 14. Each spacer member 90 includes a plurality of stakes 91 which lock into apertures provided in frame section 80. Edges of the spacer members 90 are similarly force fit within the front edge portions 84 of the liner 72, 74. The spacers 82, 90 maintain the liners 72, 74 in spaced relation with the outer shell 42, 44 and with one another.

Elongated magnets 92 are secured to each of the frame sections 76, 78 and 80 to coact with a similar magnet disposed within a door gasket (not shown) to provide an air seal when the doors 20, 22 are closed. An outer wall breaker strip 94 extends between the liners 72, 74 and the front marginal edges 53, 55 of the outer shell sections 42, 44 defining a seamless front face for said cabinet. An additional breaker strip 96 extends between the freezer section liner 72 and the fresh food section liner 74. The breaker strips are similar to that disclosed in copending Sisk et al U.S. patent application Ser. No. 946,931, filed Dec. 29, 1986, and titled Breaker Strip for a Refrigerator, assigned to the assignee of the present invention, the specification of which is hereby incorporated by reference.

A body of insulation 98 is disposed between the liners 72, 74 and the outer shell sections 42, 44. In the preferred embodiment, foam insulation is blown in which then hardens to add rigidity to the cabinet. Additionally, it has been discovered that the hardened insulation 98 coacts with the inwardly extending duct 34 to provide additional strength and rigidity to the cabinet than would result from an outwardly extending duct.

Thus, the invention broadly comprehends a cabinet construction for a refrigeration apparatus which is adapted to provide added strength thereto for anyone of a plurality of different cabinet widths to minimize twisting or swaying of the cabinet when it is being moved.

The foregoing disclosure of the preferred embodiment is illustrative of the broad inventive concepts comprehended by the invention.

We claim:

1. In a refrigeration apparatus cabinet including a liner having a selected width, the improvement comprising:

an outer shell including first and second outer shell sections, each of said shell sections having a sidewall and a backwall, the width of the backwall of said second outer shell section being selected according to the liner width; and means including adjustably overalpped portions of the backwalls of said first and second outer shell sections for forming a box beam in said shell to add strength to said cabinet for any one of a plurality of different selected liner widths.

2. The improvement according to claim 1 further including means associated with said backwall of both said first and second outer shell sections for providing a standard sized box beam for any selected liner width.

3. The improvement according to claim 1 wherein said providing means comprises an inner forwardly turned flange and an inwardly extending distal portion for each backwall with the distal portions of each said section backwall being secured to one another to define a recess, and a cover section overlying said recess and secured thereto.

4. The improvement according to claim 1 wherein said box beam is provided at a fixed distance from said first outer shell section sidewall for any one of a plurality of different cabinet widths.

5. A refrigeration apparatus cabinet comprising:

first and second outer shell sections, each of said shell sections having an outer sidewall and a backwall, said backwall including an inner forwardly turned flange and an inwardly extending distal portion;

first securing means for securing said distal portion of said first shell section in overlapping relation to said distal portion of said second shell section to define a rearwardly opening recess;

a cover section overlying said rearwardly opening recess, said distal portions of the shell sections and said cover section cooperatively defining a box beam;

second securing means for securing said cover section to said backwall sections;

an inner liner within and spaced inwardly from said outer shell sections;

a body of insulation disposed between said outer shell sections and said liner; and third securing means for securing said inner liner to said outer shell sections, said box beam providing added rigidity to the refrigeration apparatus cabinet.

6. The cabinet according to claim 5 wherein said outer shell sections and said cover section comprise sheet metal sections.

7. The cabinet according to claim 6 wherein said first securing means comprises a plurality of spot welds securing said distal portions.

8. The cabinet according to claim 6 wherein said second securing means comprises a plurality of screws securing said cover section to said backwall sections.

9. A refrigeration apparatus cabinet comprising:

first and second outer shell sections, each of said shell sections having an outer sidewall and a backwall, said backwall including an inner forwardly turned flange and an inwardly extending distal portion;

first securing means for securing said distal portion of said first shell section in overlapping relation to said distal portion of said second shell section to define a rearwardly opening recess;

a cover section overlying said rearwardly opening recess defining a box beam;

second securing means for securing said cover section to said backwall sections;

an inner liner within and spaced inwardly from said outer shell sections;

a body of insulation disposed between said outer shell sections and said liner; and third securing means for securing said inner liner to said outer shell sections, said box beam providing added rigidity to the refrigeration apparatus cabinet, said third securing means comprising a breaker strip extending between said liner and said outer shell sections.

10. A refrigeration apparatus cabinet comprising:

first and second outer shell sections, each of said shell sections having an outer sidewall and a backwall, said backwall including an inner forwardly turned flange and an inwardly extending distal portion;

first securing means for securing said distal portion of said first shell section in overlapping relation to said distal portion of said second shell section to define a rearwardly opening recess;

a cover section overlying said rearwardly opening recess defining a box beam;

second securing means for securing said cover section to said backwall sections;

an inner liner within and spaced inwardly from said outer shell sections;

a body of insulation disposed between said outer shell section and said liner; and third securing means for securing said inner liner to said outer shell sections, said box beam providing added rigidity to the refrigeration apparatus cabinet, said third securing means comprising a support frame spot welded at a front marginal edge of said sidewalls and spacer means for mechanically linking said frame to said liner.

11. A refrigeration apparatus cabinet comprising:

first and second outer shell sections, each of said shell sections having an outer sidewall and a backwall, said backwall including an inner forwardly turned flange and an inwardly extending distal portion;

first securing means for securing said distal portion of said first shell section in overlapping relation to said distal portion of said second shell section to define a rearwardly opening recess;

a cover section overlying said rearwardly opening recess defining a box beam;

second securing means for securing said cover section to said backwall sections;

an inner liner within and spaced inwardly from said outer shell sections;

a body of insulation disposed between said outer shell sections and said liner;

third securing means for securing siad inner liner to said outer shell sections, said box beam providing added rigCidity to the refrigeration apparatus cabinet; and a breaker strip disposed forwardly of said front marginal edge and secured to said frame, said breaker strip extending between said front marginal edge of said outer wall and said liner, said breaker strip providing a seamless front face for said cabinet.

12. A cabinet for a refrigerator/freezer having a machine compartment at the top thereof, comprising:

first and second outer shell sections, each of said shell sections having an outer sidewall and a backwall, said backwall including an inner forwardly turned flange and an inwardly extending distal portion;

first securing means for securing said distal portion of said first shell section in selected overlapping relation to said distal portion of said second shell section to define a rearwardly opening recess;

a cover section overlying said rearwardly opening recess defining a duct;

second securing means for securing said cover section to said backwall sections;

a first liner having a selected width within and spaced inwardly from said outer shell sections;

a second liner having a selected width within and spaced inwardly from said outer shell sections and said first liner;

first breaker means for securing said first and second liners to said first and second outer shell sections;

second breaker means for securing said first liner to said second liner; and a body of insulation disposed between said outer shell sections and said liners, wherein said duct and said insulation together act as a beam to provide added strength to the cabinet.

13. The cabinet according to claim 12 wherein said outer shell sections and said cover section comprise sheet metal sections.

14. The cabinet according to claim 13 wherein said first securing means comprises a plurality of spot welds securing said distal portions.

15. The cabinet according to claim 13 wherein said second securing means comprises a plurality of spot welds securing said cover section to said sidewall sections.

16. The cabinet according to claim 12 wherein said first breaker means comprises a breaker strip extending between said liners and said outer shell sections.

17. The cabinet according to claim 12 wherein said second breaker means comprises a breaker strip extending between said first and second liners.

18. The cabinet according to claim 16 wherein said first breaker means further comprises a support frame.

* * * * *